US008723587B1

(12) United States Patent
Su

(10) Patent No.: US 8,723,587 B1
(45) Date of Patent: May 13, 2014

(54) VOLTAGE GENERATOR

(71) Applicant: Himax Technologies Limited, Tainan (TW)

(72) Inventor: Hsin-Chia Su, Tainan (TW)

(73) Assignee: Himax Technologies Limited, Tainan (TW)

( * ) Notice: Subject to any disclaimer, the term of this patent is extended or adjusted under 35 U.S.C. 154(b) by 0 days.

(21) Appl. No.: 13/786,116

(22) Filed: Mar. 5, 2013

(51) Int. Cl.
*G06G 7/12* (2006.01)

(52) U.S. Cl.
USPC ..... 327/355; 327/50

(58) Field of Classification Search
USPC ..... 327/354–356, 359, 361, 50; 341/143, 341/144, 134–136
See application file for complete search history.

(56) References Cited

U.S. PATENT DOCUMENTS

2011/0128045 A1* 6/2011 Nakamoto ..... 327/50

* cited by examiner

*Primary Examiner* — Lincoln Donovan
*Assistant Examiner* — Diana J Cheng
(74) *Attorney, Agent, or Firm* — Stout, Uxa, Buyan & Mullins, LLP; Donald E. Stout

(57) ABSTRACT

A voltage generator includes a digital-to-analog (D/A) converting device configured to convert an input voltage to a pair of analog voltages, and a voltage mixer coupled to receive the analog voltages via electrical wirings to combine one or both of the analog voltages into an output voltage.

10 Claims, 4 Drawing Sheets

| D1&D0 | 11 | 10 | 01 | 00 |
|---|---|---|---|---|
| OUT1 | A | A | A | A |
| OUT2 | B | B | A | A |
| OUT3 | B | B | A | A |
| OUT4 | B | A | B | A |

VOLTAGE GENERATOR

BACKGROUND OF THE INVENTION

1. Field of the Invention

The present invention generally relates to a voltage generator, and more particularly to a voltage generator adaptable to a source driver in a liquid crystal display.

2. Description of Related Art

A digital-to-analog converter (DAC) is a device that converts a digital code to an analog signal, and is widely adopted, for example, in a source driver integrated circuit (IC) of a liquid crystal display (LCD). The DAC may be used, accompanied by other circuits, in the source driver to generate a variety of gamma voltages for performing gamma correction.

The gamma voltages may, for example, be generated by interpolation between two voltage levels (e.g., 10 and 5 volts). The interpolated voltages by the DAC are then transferred, via electrical wirings, to an amplifier or a mixing circuit to generate the required gamma voltage. However, the wirings for transferring the voltages may occupy precious circuit area. Moreover, when odd-numbered e.g., three) wirings are used, the loading carried by the wirings is occasionally not uniform (or resistance mismatching) caused by varied digital code. Accordingly, dark spots may annoyingly appear on the LCD to result in a clouding phenomenon called "mura" or "unevenness."

For the foregoing reasons, a need has thus arisen to propose a novel scheme for eliminating the mura phenomenon.

SUMMARY OF THE INVENTION

In view of the foregoing, an embodiment of the present invention discloses a voltage generator adaptable to a source driver in a liquid crystal display to not only reduce circuit area but also stabilize loading on the wirings between circuits, therefore reducing mura phenomenon.

According to one embodiment, a voltage generator includes a digital-to-analog (D/A) converting device and a voltage mixer. The D/A converting device converts an input voltage to a pair of analog voltages. The voltage mixer receives the analog voltages via electrical wirings to combine one or both of the analog voltages into an output voltage.

DETAILED DESCRIPTION OF THE INVENTION

Figure 1:
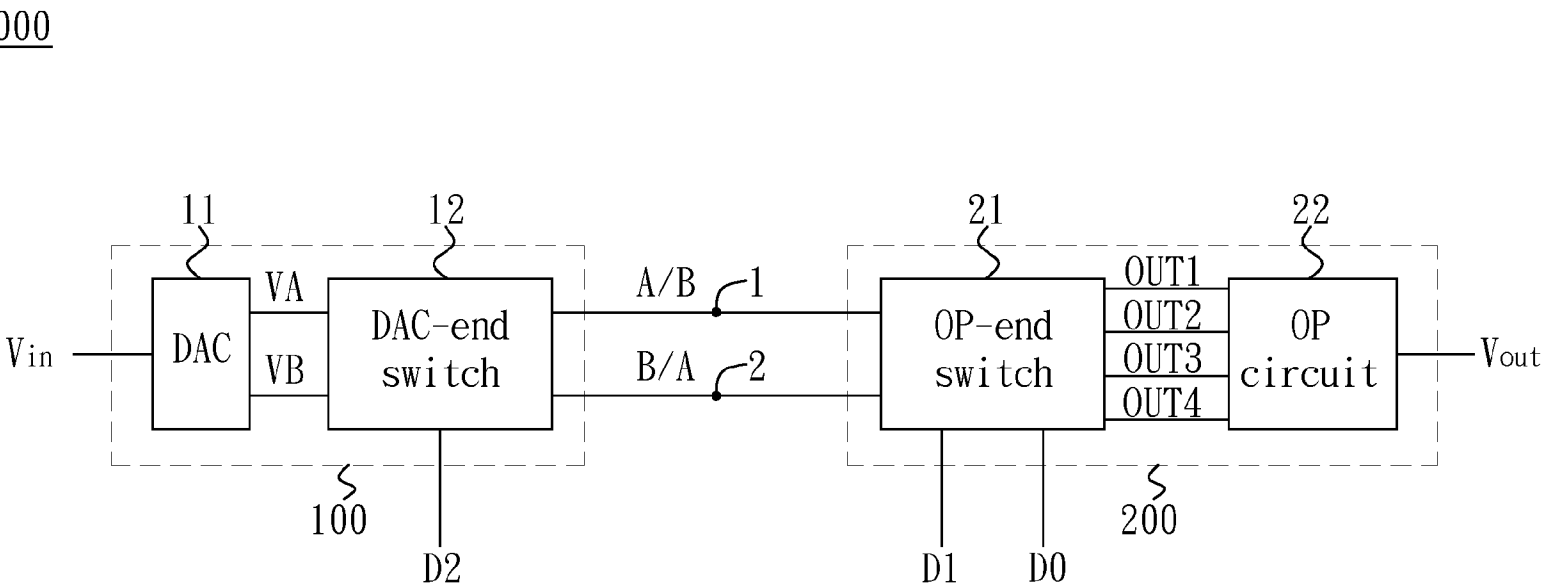
FIG. 1 shows a block diagram illustrating a voltage generator adaptable to a source driver in a liquid crystal display according to one embodiment of the present invention.

FIG. 1 shows a block diagram illustrating a voltage generator 1000 adaptable to a source driver in a liquid crystal display (LCD) according to one embodiment of the present invention. The illustrated voltage generator 1000 generates a required output voltage Vout that may, but not necessarily, be used as a gamma voltage in the source driver.

In the embodiment, the voltage generator 1000 includes a digital-to-analog (D/A) converting device 100 and a voltage mixer 200. The D/A converting device 100 converts a (digital) input voltage Vin to a pair of analog voltages (A, B) at nodes 1 and 2. The pair of analog voltages (A, B) is then forwarded, via electrical wirings in an integrated circuit, to the voltage mixer 200 that combines (or mixes) one or both of the analog voltages (A, B) into the output voltage Vout.

Specifically speaking, the D/A converting device 100 of the embodiment includes a digital-to-analog converter (DAC) 11 that receives the input voltage Vin and accordingly generates a pair of converted voltages (VA, VB). The D/A converting device 100 also includes a DAC-end switch 12 that receives the pair of converted voltages (VA, VB), which are then selectively coupled to the nodes 1 and 2 at the electrical wirings between the D/A converting device 100 and the voltage mixer 200. In other words, the first/second converted voltages VA and VB may be coupled to the nodes 1 and 2 respectively, or alternatively, be coupled to the nodes 2 and 1 respectively. In the specification, the term "DAC-end" switch means that the switch 12 is nearer the DAC 11 than the voltage mixer 200 with regard to length of the electrical wirings between the D/A converting device 100 and the voltage mixer 200.

Figure 2A:
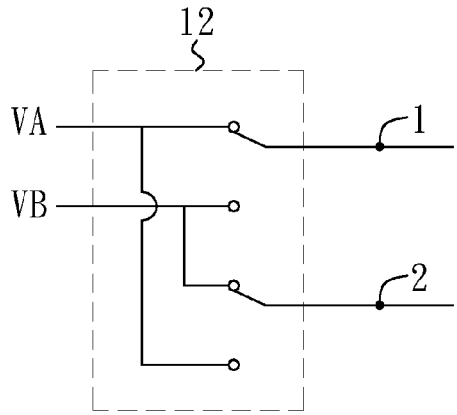
FIG. 2A shows a schematic diagram illustrating operation of the DAC-end switch of FIG. 1.

FIG. 2A shows a schematic diagram illustrating operation of the DAC-end switch 12 of FIG. 1. As shown in FIG. 2A, the DAC-end switch 12 may operate as a double pole double throw (DPDT) switch, which either couples the first/second converted voltages VA and VB to the nodes 1 and 2 respectively, or couples the converted voltages VA and VB to the nodes 2 and 1 respectively.

Figure 2B:
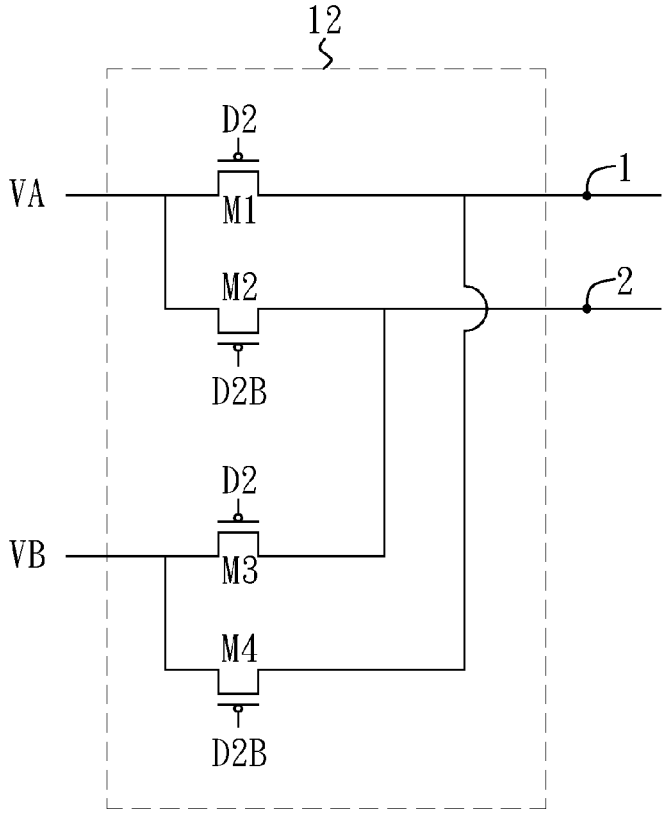
FIG. 2B shows a circuit diagram implementing the DAC-end switch of FIG. 1.

FIG. 2B shows a circuit diagram implementing the DAC-end switch 12 of FIG. 1. As shown in FIG. 2B, the first converted voltage VA is electrically coupled to the node 1 via a first transistor M1 (e.g., a P-type metal-oxide-semiconductor (PMOS) transistor) controlled by a control signal D2, and is electrically coupled to the node 2 via a second transistor M2 (e.g., a PMOS transistor) controlled by an inverted signal D2B that is the inverse of the control signal D2; the second converted voltage VB is electrically coupled to the node 2 via a third transistor M3 (e.g., a PMOS transistor) controlled by the control signal D2, and is electrically coupled to the node 1 via a fourth transistor M4 (e.g., a PMOS transistor) controlled by the inverted signal D2B.

Figures 3, 4:
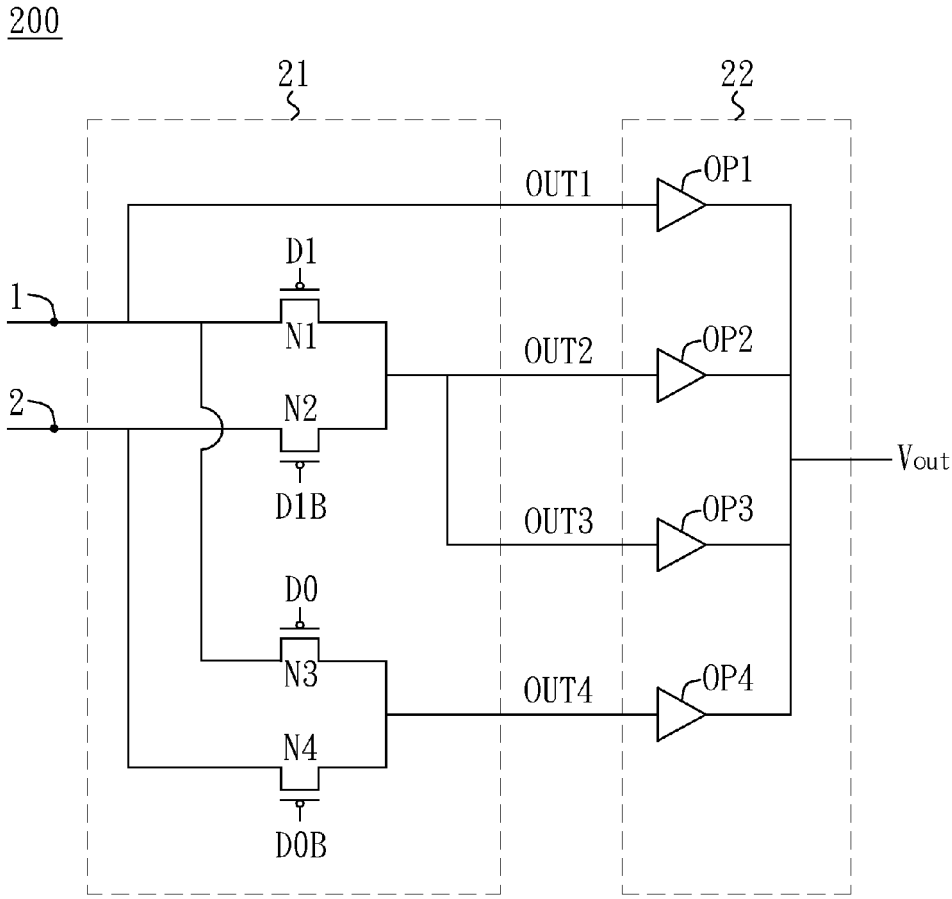
FIG. 3 shows an exemplary table illustrating mapping from analog voltages to mapped voltages with respect to a digital code.
FIG. 4 shows a detailed circuit diagram implementing the voltage mixer of FIG. 1.

The voltage mixer 200 of the embodiment includes an operational amplifier (OP)-end switch 21 that electrically couples the nodes 1 and 2 of the electrically wirings (between the D/A converting device 100 and the voltage mixer 200) to receive the pair of analog voltages (A, B), and accordingly maps out four mapped voltages (OUT1, OUT2, OUT3, OUT4), which are generated by mapping one or both of the analog voltages (A, B). FIG. 3 shows an exemplary table illustrating mapping from the analog voltages (A, B) to the mapped voltages (OUT1, OUT2, OUT3, OUT4) with respect to a digital code (D1, D0). The mapped voltages (OUT1, OUT2, OUT3, OUT4) are then coupled to an operational amplifier (OP) circuit 22, which generates the output voltage Vout by mixing, e.g., taking an average of, the mapped voltages (OUT1, OUT2, OUT3, OUT4). In the specification, the term "OP-end" switch means that the switch 21 is nearer the OP circuit 22 than the D/A converting device 100 with regard to length of the electrical wirings between the D/A converting device 100 and the voltage mixer 200.

FIG. 4 shows a detailed circuit diagram implementing the voltage mixer 200 of FIG. 1. As shown in FIG. 4, a first operational amplifier OP1 is electrically coupled to receive the first analog voltage at the node 1. A second operational amplifier OP2 is electrically coupled to receive either the first analog voltage at the node 1 via a first transistor N1, for example, a PMOS transistor (controlled by a first digital signal D1 of the digital code) or the second analog voltage at the node 2 via a second transistor N2, for example, a PMOS transistor (controlled by an inverted first digital code D1B that is the inverse of D1). An input node of a third operational amplifier OP3 is electrically coupled to an input node of the second operational amplifier OP2. A fourth operational amplifier OP4 is electrically coupled to receive either the first analog voltage at the node 1 via a third transistor N3, for example, a PMOS transistor (controlled by a second digital signal D0 of the digital code) or the second analog voltage at the node 2 via a fourth transistor N4, for example, a PMOS transistor (controlled by an inverted second digital code DOB that is the inverse of D0). In the embodiment, each of the four operational amplifiers OP1-OP4 is configured with a gain of /1;4 such that sum (i.e., the output voltage Vout) of output voltages of the four operational amplifiers OP1-OP4 is an average of their input voltages.

Figure 5:
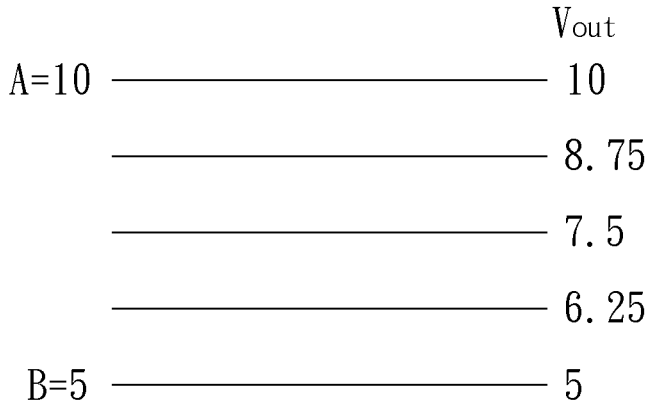
FIG. 5 schematically shows exemplary voltage levels demonstrating the analog voltages received by the OP-end switch of FIG. 4 and the output voltage generated by the OP circuit of FIG. 4.

FIG. 5 schematically shows exemplary voltage levels demonstrating the analog voltages (A, B) received by the OP-end switch 21 (of FIG. 4) and the output voltage Vout generated by the OP circuit 22. As exemplified in FIG. 5, analog voltages of 10 and 5 volts are received by the OP-end switch 21. According to the switching of the transistors N1-N4, four possible levels (e.g., 10, 8.75, 7.5 and 6.25) are available at the node associated with the output voltage Vout.

According to the embodiment discussed above, only two, instead of four, wirings between the D/A converting device 100 and the voltage mixer 200 are required with regard to the digital code (D1, D0). Therefore, circuit area for routing the wirings may be reduced. Moreover, as even-numbered (two in the example) wirings are employed in the embodiment, the loading carried by the wirings may be substantially stabilized or consistent (or resistance matched) no matter how the input voltage Vin varies.

Although specific embodiments have been illustrated and described, it will be appreciated by those skilled in the art that various modifications may be made without departing from the scope of the present invention, which is intended to be limited solely by the appended claims.

What is claimed is:

1. A voltage generator, comprising:

a digital-to-analog (D/A) converting device configured to convert an input voltage to a pair of analog voltages; and a voltage mixer coupled to receive the analog voltages via electrical wirings to combine one or both of the analog voltages into an output voltage;

wherein the D/A converting device comprises:

a digital-to-analog converter (DAC) configured to receive the input voltage and accordingly generate a pair of converted voltages including a first converted voltage and a second converted voltage; and a DAC-end switch coupled to receive the pair of converted voltages, and then selectively couple the converted voltages to a first node and a second node at the electrical wirings between the D/A converting device and the voltage mixer.

2. The voltage generator of claim 1, wherein the DAC-end switch is nearer the DAC than the voltage mixer with regard to length of the electrical wirings between the D/A converting device and the voltage mixer.

3. The voltage generator of claim 1, wherein the DAC-end switch comprises a double pole double throw (DPDT) switch, which couples the converted voltages to the first/second nodes.

4. The voltage generator of claim 1, wherein the DAC-end switch comprises:

a first transistor, through which the first converted voltage is coupled to the first node, the first transistor being controlled by a control signal;

a second transistor, through which the first converted voltage is coupled to the second node, the second transistor being controlled by an inverted control signal that is inverse of the control signal;

a third transistor, through which the second converted voltage is coupled to the second node, the third transistor being controlled by the control signal; and a fourth transistor, through which the second converted voltage is coupled to the first node, the fourth transistor being controller by the inverted control signal.

5. The voltage generator of claim 1, wherein the voltage mixer comprises:

an operational amplifier (OP)-end switch, coupled to receive the pair of analog voltages at a first node and a second node of the electrical wirings between the D/A converting device and the voltage mixer, and accordingly generate four mapped voltages by mapping one or both of the analog voltages, the pair of analog voltages including a first analog voltage and a second analog voltage, and a digital code including a first digital signal and a second digital signal; and an operational amplifier (OP) circuit, configured to receive the mapped voltages to generate the output voltage by mixing the mapped voltages.

6. The voltage generator of claim 5, wherein the output voltage is generated by taking an average of the mapped voltages.

7. The voltage generator of claim 5, wherein the OP-end switch is nearer the OP circuit than the D/A converting device with regard to length of the electrical wirings between the D/A converting device and the voltage mixer.

8. The voltage generator of claim 5, wherein the OP circuit comprises four operational amplifiers (OPs) including a first OP, a second OP, a third OP and a fourth OP, outputs of the OPs being summed up to generate the output voltage.

9. The voltage generator of claim 8, wherein the OP-end switch comprises:

a first transistor, through which the second OP and the third OP are electrically coupled to receive the first analog voltage at the first node, the first transistor being controlled by the first digital signal;

a second transistor, through which the second OP and the third OP are electrically coupled to receive the second analog voltage at the second node, the second transistor being controlled by an inverted first digital signal that is inverse of the first digital signal;

a third transistor, through which the fourth OP is electrically coupled to receive the first analog voltage at the first node, the third transistor being controlled by the second digital signal; and a fourth transistor, through which the fourth OP is electrically coupled to receive the second analog voltage at the second node, the fourth transistor being controlled by an inverted second digital signal that is inverse of the second digital signal;

wherein the first OP is electrically coupled to receive the first analog voltage at the first node.

10. The voltage generator of claim 8, wherein each of the four OPs is configured with a gain of ¼.

* * * * *